United States Patent [19]

Brocious

[11] Patent Number: 4,820,078

[45] Date of Patent: Apr. 11, 1989

[54] APPARATUS FOR ROAD SURFACE REPAIR WITH FIBER-REINFORCED ASPHALT

[76] Inventor: George D. Brocious, R.D. #1, Box 81, Mayport, Pa. 16240

[21] Appl. No.: 946,772

[22] Filed: Dec. 29, 1986

[51] Int. Cl.[4] ..... E01C 19/17

[52] U.S. Cl. ..... 404/92; 404/111

[58] Field of Search ..... 404/72, 75, 81, 92, 404/101, 111; 427/196, 426; 118/308; 239/124, 112; 222/148

[56] References Cited

U.S. PATENT DOCUMENTS

| | | | |
|---|---|---|---|
| 2,314,329 | 3/1943 | Ericson | 427/196 |
| 3,034,213 | 5/1962 | Milligan | 118/308 X |
| 3,096,225 | 7/1963 | Carr et al. | 427/426 X |
| 3,117,376 | 1/1964 | Nawalanic | 118/308 X |
| 3,740,260 | 6/1973 | Winn, Jr. | 427/196 X |
| 4,265,563 | 5/1981 | Marzocchi et al. | 404/75 |
| 4,311,274 | 1/1982 | Neal | 404/111 X |
| 4,511,284 | 4/1985 | Sterner | 404/111 |
| 4,535,919 | 8/1985 | Jameson | 239/124 X |
| 4,549,676 | 10/1985 | Gerich | 239/112 X |
| 4,723,710 | 2/1988 | Lucore, II | 239/124 |

FOREIGN PATENT DOCUMENTS

| | | | |
|---|---|---|---|
| 732134 | 4/1966 | Canada | 427/196 |
| 1446092 | 8/1976 | United Kingdom | 404/81 |

*Primary Examiner*—Jerome Massie, IV
*Assistant Examiner*—Matthew Smith
*Attorney, Agent, or Firm*—George C. Atwell

[57] ABSTRACT

Apparatus for patching or filling paved road surface cracks or joints includes means for simultaneously dispensing molten asphalt bitumen and monofilament strands of reinforcing fiber, wherein fiber roving is chopped into discrete segments and intermixed with the molten asphalt as the patching or joint filling application occurs. The apparatus is intended to be mounted on a mobile rig to facilitate its use, and includes an arrangement wherein the molten asphalt is continuously pumped out to a dispensing nozzle assembly and back to the storage reservoir on the rig whereby the flow maintains a continuous circuit from which the molten asphalt is selectively withdrawn for use in patching and filling operations. Also included is a means for selectively purging the circuit after use of the apparatus, and the method of utilizing the apparatus.

5 Claims, 4 Drawing Sheets

APPARATUS FOR ROAD SURFACE REPAIR WITH FIBER-REINFORCED ASPHALT

BACKGROUND OF THE INVENTION

This invention relates generally to road surface patching apparatus, and more particularly pertains to mobile equipment for use in applying filler in pavement cracks or joints, and to make pothole repairs.

The maintenance of hard paved road surfaces typically requires patching by filling of holes, cracks or fissures which develop from heavy use and/or climatic conditions. Moreover, the strip of filler normally applied between sections of new pavement tends to erode and/or deteriorate over time whereby replacement or patching is required.

Molten asphalt cement is typically used as a filler for such patching, and the art has recognized the value of intermixing reinforcing materials in the asphalt to increase the durability, thermal stability, and tensile strength of the patched area. One method of pothole patching in current use utilizes apparatus for blowing a pre-mixed aggregate and asphalt emulsion into a pothole to thereby form a patch. Another current method of crack or joint repair requires mixing of small-diameter, short-length polyester filament segments into a reservoir of preheated liquid bituminous patching material which is then dispersed through a hose to a manually-guided dispensing nozzle used to apply the material in a crevice or other area to be filled.

There are distinct advantages in the utilization of fiber-reinforced asphalt cement in road surface repair. The adherence characteristics of the asphalt cement are well-known. Equally well-known are the disadvantages inherent in asphalt cement as a patching material, such as its tendency to shrink and crack and its relatively low tensile strength. The addition of chopped fibers to reinforce the asphalt significantly increases its tensile strength, enhances its thermal stability, and provides a relatively durable and long-lasting repair.

A conventional crack or joint patching method employs apparatus having a heated vat or reservoir wherein bags of chopped fiber are dumped into the molten material to create the mix. The flowable mix is then pumped out through a large-diameter hose to a manually-held and directed wand or dispensing nozzle by means of which the material is pumped into the crevice or hole to be patched. There are a number of problems associated with this practice, including difficulty in obtaining uniform distribution of the fibers in the molten asphalt, accurately controlling the ratio of fiber fill to asphalt, and maintenance of the dispersal components of the apparatus which are required to pump and deliver a mixture of relatively high viscosity.

A major limitation of presently available equipment which combines reinforcing fiber with asphalt-type patching medium is the inability of the operator to vary the proportions of the combined materials in accordance with conditions or requirements of the area to be repaired.

SUMMARY OF THE INVENTION

The present invention comprehends a simplification of crack and joint patching procedure using apparatus adapted to chop roving into filament segments at a point immediately adjacent the patch or fill site and intermix it with a flow of liquified asphalt cement or similar congealing patching material as the fill or patch is applied.

In its presently preferred embodiment, the apparatus of the present invention is a platform, preferably a mobile rig, supporting a system for storing and dispensing two materials separately, for uniform intermixing which occurs as an incident of the dispensing action. The apparatus includes a first subsystem for containing and dispensing liquid asphalt or similar material, and a second sub-system for containing and dispensing fiber roving from a pre-wound coil. Appropriate components are provided to repeatedly direct a flow of the liquid asphalt and the fiber roving to an outboard manually-guided delivery nozzle assembly. The delivery nozzle assembly includes a motorized chopper or cutting machine which renders the roving into discrete segments at a predetermined rate. The delivery nozzle assembly, which further includes an asphalt discharge nozzle located immediately adjacent the discharge tube for the chopped fiber, is intended to be carried by an operator whereby the cutting machine is located forwardly of the operator and generally above the asphalt discharge nozzle.

A feature of the first sub-system of the apparatus is the disposition of the conduit means for delivering the molten ashpalt from the reservoir to the manually-guided delivery nozzle assembly. Instead of a conduit which extends from the reservoir to the asphalt dispensing nozzle, as utilized in prior art apparatus, a conduit means is provided which constitutes a continuous circuit for maintaining a circuitous flow from the reservoir and to the delivery nozzle assembly, then back to the reservoir. Selected dispensing of asphalt from the nozzle is accomplished by diverting the flow from its continuously cycling path in the circuit. By the aforedescribed means, a uniformity of temperature is maintained in the liquid asphalt moving through the circuit whereby excessive cooling and coalescence of the material within the conduit is avoided.

A further feature of the presently preferred embodiment of the apparatus of the invention is the provision of means for selectively purging the asphalt material from the circuit after use of the apparatus. The manner in which this purging operation is accomplished results in definite benefits as compared to prior art equipment, including avoidance of asphalt reservoir contamination, and significant conservation of asphalt and purging solvent.

The apparatus of the present invention enables use of a method for patching cracks or holes, or filling joints, in paved road surfaces wherein reinforcing fibers can be uniformly dispersed at a controlled rate into a molten medium, as an incident of the actual patching or crevice-filling application, prior to the solidification of the medium.

The present invention enables a patching operation wherein direct control of molten medium dispensing and fiber segment dispensing is with the operator at the patch site. The operator can determine and distribute a preferred proportion of the materials or dispense one material without the other, in accordance with specific site requirements.

With the equipment hereinafter disclosed, the repair of large areas can also be uniquely addressed. Where desirable, solid aggregate is distributed into the area, and asphalt and fiber segments are then dispensed in a preferred proportion to complete the fill.

Upon a full understanding of the apparatus of this invention and the method for its use, from the ensuing detailed description and the accompanying drawings, any person skilled in the art will appreciate that currently available highway surface crack-filling equipment may be easily modified by appropriate retrofit conversion to inexpensively obtain apparatus having the capabilities of the present invention. By such conversion, comparatively superior benefits can be obtained without excessive high capital investment.

DETAILED DESCRIPTION OF THE PREFERRED EMBODIMENT

Figure 1:
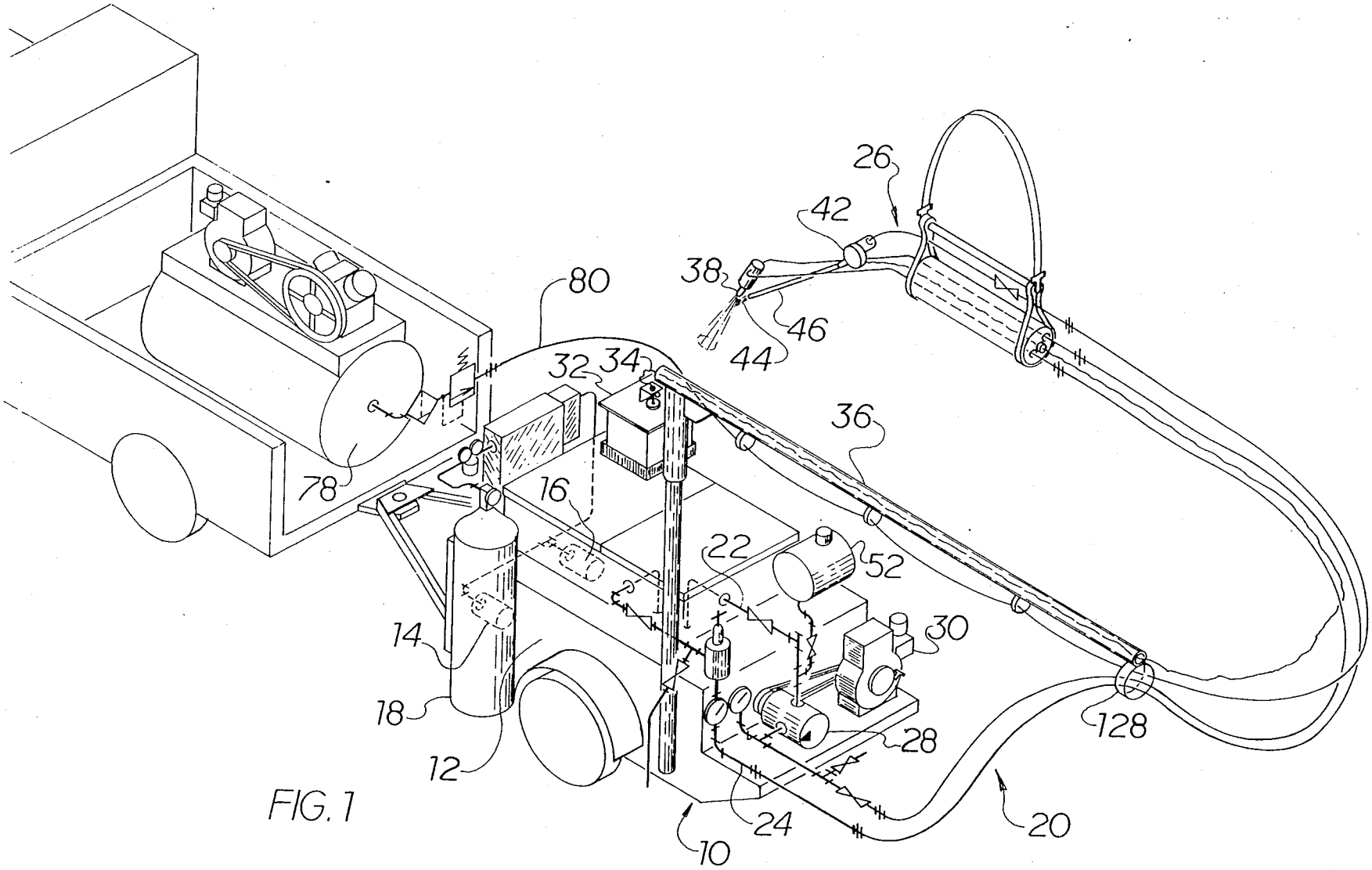
FIG. 1 is an isometric view of one presently preferred form of apparatus of the disclosed invention, having certain components thereof schematically represented.

FIG. 1 shows one preferred form of the apparatus of the present invention, which includes a mobile rig 10 having a substantially large container or reservoir 12. Means is provided for heating the reservoir 12, in the form of burners 14 and 16 adapted to receive propane gas from storage tank 18. Leading out from the reservoir 12 is a conduit 20 comprising an outlet line or conduit portion 22 and a return line or conduit portion 24. The conduit 20 is formed of heavy-duty, substantially large-diameter, flexible hose which forms a continuous flow circuit between the reservoir 12 and delivery nozzle assembly 26. In flow communications with the circuit 20 is a pump 28 driven by an engine 30.

Figure 4:
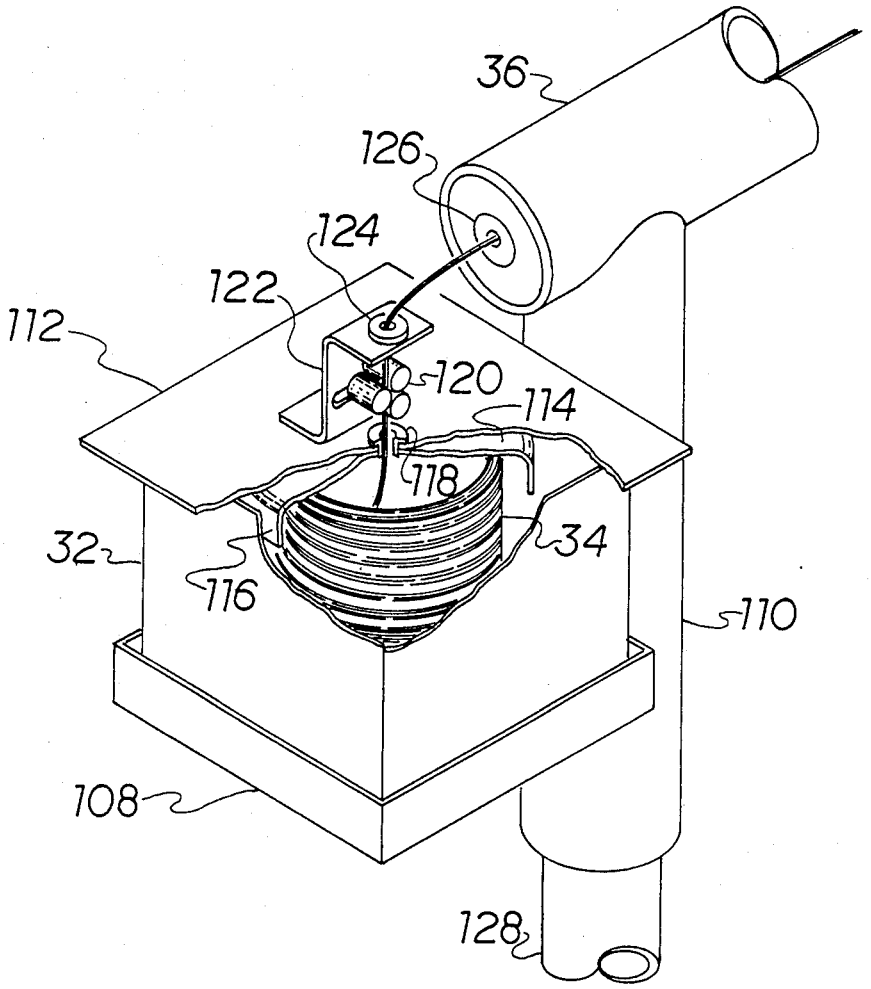
FIG. 4 is a fragmentary enlarged view of fiber roving storage means first shown in FIG. 1.

The rig 10 supports a container 32 (shown in greater detail in FIG. 4) adapted to store coiled fiber roving 34. A boom 36 extends from the rig 10 as a means of supporting both the portions 22 and 24 of the conduit 20 and the roving 34 drawn from its coil in the container 32.

Figures 3, 3A:
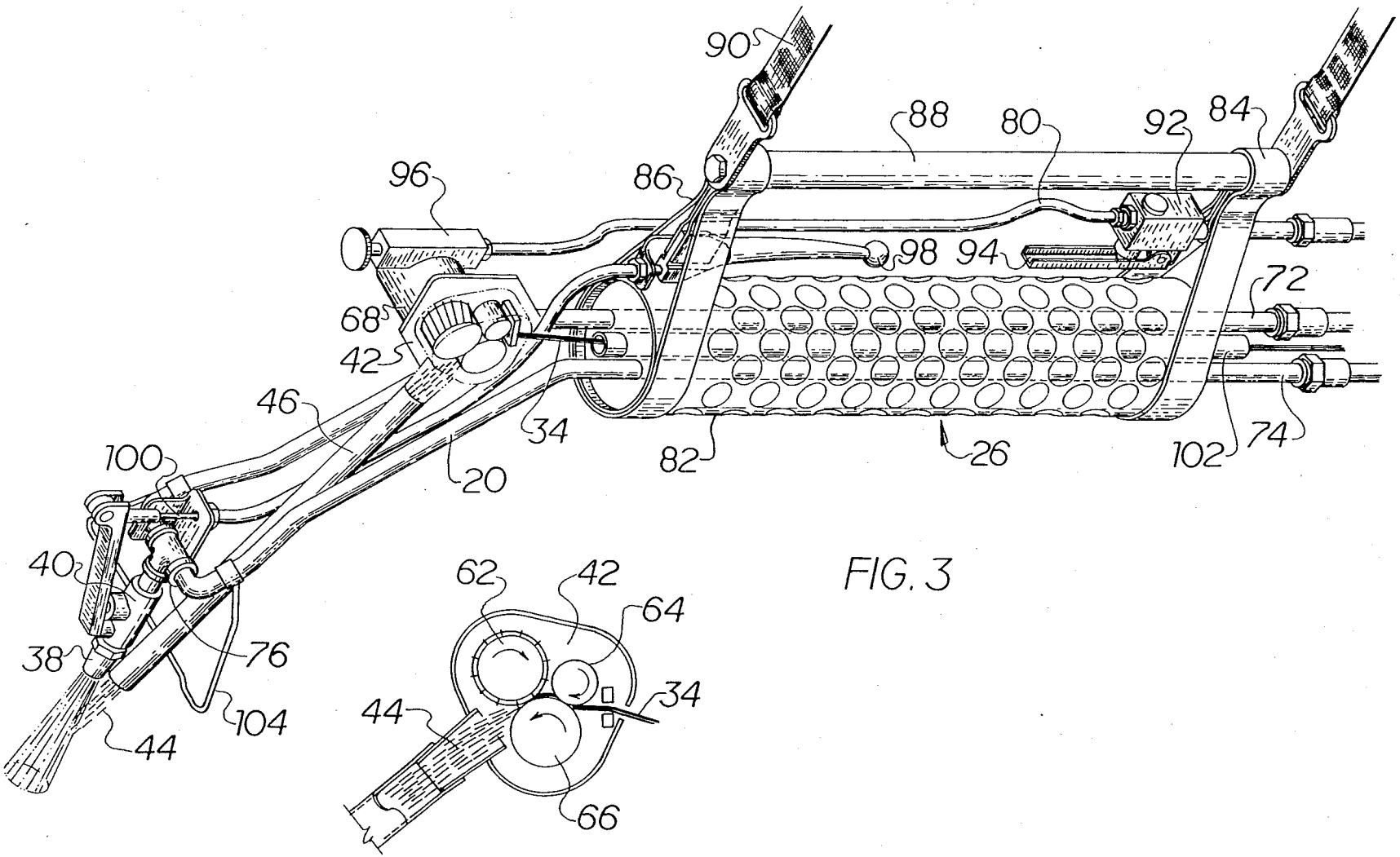
FIG. 3 is a perspective view of a delivery nozzle assembly forming part of the apparatus first shown in FIG. 1.
FIG. 3A is a side elevational view of a fiber chopping device, first shown in outline representation in FIGS. 1 and 2, and also illustrated in FIG. 3.

The delivery nozzle assembly 26, shown in greatest detail in FIG. 3, includes a dispensing nozzle 38 having a selectively operable valve 40, and a motorized fiber chopping device 42 which receives the roving 34 and chops it into discrete segments 44 for discharge through a tube 46.

Having heretofore described certain major components of the apparatus of this invention, its general operation can now be explained. It is believed the apparatus can be best understood if it is considered as a platform-mounted system for storing and dispensing, along distinct separate channels, liquid asphalt and fiber reinforcing material, to a pavement repair site. The foregoing system includes a first sub-system for storing and dispensing liquid asphalt, and a second subsystem for storing and dispensing the reinforcing material. The products of both sub-systems are delivered to a manually-held and guided delivery nozzle assembly as shown in FIG. 3.

In the first sub-system, asphalt cement, which is deposited in the reservoir 12 from a large storage tank (not shown) is maintained in the liquified or molten state in the reservoir 12 by heating it and maintaining it at a predetermined temperature by burners 14 and 16 which burn propane supplied from the tank 18. When operation is instituted, the engine 30 drives the pump 28 which pumps the liquified asphalt cement out of the reservoir 12 and through the conduit or circuit 20. Specifically, the asphalt material is drawn from the reservoir 12, first through the conduit portion 22 which, in the area between the reservoir and the pump 28, is preferably formed of standard one-inch diameter pipe. From the tank 28 outwardly to the delivery nozzle assembly 26 and then back to the rig 10, the circuit 20 is comprised of heavy-duty industrial hose of substantially the same diameter as pipe 22. At the outer end of the circuit 20, in the delivery nozzle assembly 26, metal pipe fittings 72 and 74 are interposed in the circuit 20 to provide rigidity for the assembly 26 and directional control for the operator. The pipes 72 and 74 converge and interconnect at a tee fitting 76 (FIG. 3) which serves as a mounting base for the nozzle 38. By the arrangement described, liquified asphalt contained in the reservoir 12 is, during operation of the apparatus, continuously circulated out through the assembly 26 and back to the reservoir, and valve 40 is selectively actuated to draw the asphalt material from the circuitous flow and eject it outwardly through the nozzle 38 during a patch or fill application.

Figure 2:
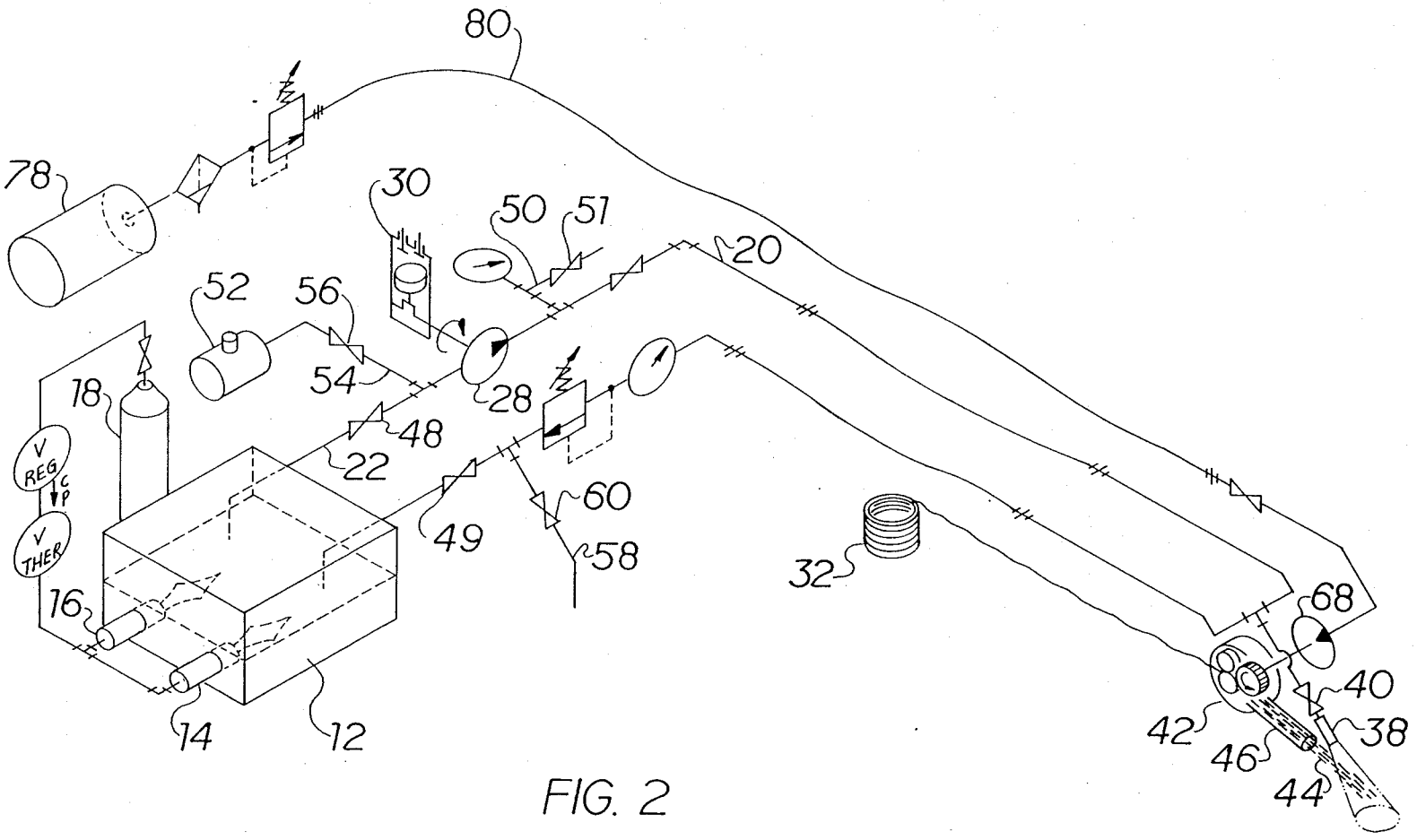
FIG. 2 is a schematic layout corresponding to the apparatus first shown in FIG. 1.

The aforedescribed first sub-system preferably includes a means for purging circuit 20 after use, including valves 48 and 49 disposed in the circuit 20 closely adjacent to reservoir 12, and an air input line 50 located downstream from the pump 28 and having a normally closed valve 51 (FIG. 2). The foregoing components enable a purging operation which involves temporarily coupling an air hose, as hereafter more specifically described, to line 50, closing valve 48 and opening valve 51 to permit compressed air to enter circuit 20 and force asphalt in the circuit back into the reservoir 12. The direction of flow of the compressed air in circuit 20 is downstream from pump 28 and outward through the dispensing assembly 26, then back to the reservoir through inlet portion 24. Valve 40 at nozzle 38 is closed during this operation. Following evacuation of circuit 20 by compressed air, valve 51 and valve 49 are closed after which appropriate solvent contained in tank 52 is introduced into circuit 20 through conduit or line 54 by opening valve 56. Simultaneously, an oppositely disposed evacuation line 58 is opened through manipulation of valve 60. Pump 28 is then actuated to force the solvent through the circuit 20 and evacuate any residual asphalt material out through line 58. Following cleansing of circuit 20 as heretofore described, valves 56 and 60 are closed and valves 48 and 49 are reopened to replace circuit 20 in communication with the reservoir 12. During the cleansing operation, valve 40 can be selectively opened to permit solvent to purge the passage in nozzle 38.

The second sub-system of the apparatus comprises the roving container 32, means for guiding the roving unwound from the container 32 to the delivery nozzle assembly 26 and the motorized chopping device 42. The device 42 comprises (see FIG. 3A) a drive wheel 62 and idler wheels 64 and 66 for gripping and advancing the roving to the cutter wheel. A pneumatic motor (not shown) is contained in housing 68 for rotatably driving the cutter assembly. For such purpose, compressed air from a tank 78 (FIGS. 1 and 2) is directed to the motor through air line 80 (FIG. 3). An air by-pass valve (not shown) is preferably provided within the device 42 to add air flow discharge momentum to the fiber segments which receive initial momentum from the cutting action. Air line 80 is preferably adapted to be uncoupled from the motor of device 42 so it can be coupled to line 50 during the purging action hereinbefore described.

The delivery nozzle assembly 26 shown in FIG. 3, on which the cutter device 42 is supported, is designed to be carried by a workman and operated to dispense molten asphalt and fiber segments at its downwardly directed output end. The assembly 26 has a rigid metallic tube 82 which serves as a base for the assembly and as a heat shield and radiator in view of the extension therethrough of pipes 72 and 74 through which the liquid asphalt is pumped. Secured at opposite ends of the tube 82 are rigid hangers 84 and 86, the upper ends of which are interconnected by a handlebar 88. A shoulder strap or sling 90 has each of its ends secured at opposite ends of the handlebar 88. Between the handlebar 88 and the tube 82 is an airflow control valve 92 which permits the operator to selectively actuate the cutter device 42 by manipulation of a lever 94. At its outer end, the air line 80 couples to a speed control valve 96 which may be preset to regulate the volume of airflow to the motor of the cutter device 42 and thus establish the speed at which the motor will drive the wheel 66 when the valve 92 is fully opened. Forwardly from the valve 92 and downwardly from the handlebar 88 is a lever 98 which is pivotally mounted to retract a cable 100 which, in turn, will open the valve 40. Extending through the tube 82 is a substantially smaller central guide tube 102 which serves to guide the roving 34 to the cutter device 42. At the outer lowermost end of the assembly 26, a rigid, downwardly projecting, wire-frame runner 104 is provided to serve as a ground support and spacer whereby the output ends of the nozzle 38 and tube 20 will be maintained at a predetermined distance from ground level during a crack patching or hole filling operation.

The roving container or storage means 32 (FIG. 4) includes a rectilinear boxlike portion 106 having an upper open end. The box 106 is supported in a tray 108 which is firmly secured (by means not shown) to a base portion 110 of the boom 36. A movable cover member 112 is provided for the box 106 and, on its underside, a metallic circular pan member 114, having a downwardly extending peripheral skirt portion 116, serves to retain and centrally maintain the pre-wound coil of roving 34 within the box 106. Affixed in a central opening within the cover 112 is a ceramic guide bushing 118 which extends down through a corresponding central opening in the pan member 114. Directly above the bushing 118 is a pinch roller assembly 120 mounted on a bracket 122. At the upper end of the bracket 122 is a ceramic guide bushing 124, and a similar guide bushing 126 is provided in the end surface of the boom 36.

During use of the apparatus 10 (FIG. 1) the roving 34 is guided outwardly from the box 106 through the bushing 118 and thence upwardly through the bushing 124. The pinch roller assembly is provided to maintain a constant predetermined tension on the roving and thus eliminate any slack in the roving line between the point where the roving extends through the opening in bushing 124 and the point where it enters the cutting device 42 (see FIG. 3). Any suitable means for maintaining tension on the roving can be utilized, however, in the embodiment shown, the pinch roller assembly 120 serves this purpose. The assembly comprises three idling rollers which are adapted to rotate on mounting bolts affixing them to the bracket 122. Two of the rollers are mounted one directly above and parallel to the other while the third is laterally disposed relative to the first two and adapted to be laterally adjusted to increase or decrease the pressure against the roving line passing therebetween.

It is preferred that the base 110 of the boom 36 be mounted to enable manual rotation of the boom 36 by turning it on a stationary, vertically-extending, support shaft 128. By virtue of the pan 128 being permanently secured to the base 110, the storage box 106 rotates with the base 110 whereby the established alignment of the roving going into the boom through bushing 126 is maintained regardless of the position of the boom 36.

In the illustrated embodiment of the apparatus shown in FIG. 1, the air supply for driving the cutter device 42 is mounted separately on the bed of a small truck, and all other major components of the disclosed system are carried on a single-axle trailer drawn by the truck. The boom 36 is used to suspendably guide the extension of the air line 80 from the air supply 78, the roving 34 and the hoses used in the circuit 20. In the embodiment shown, the roving 34 extends centrally through the boom 36 whereas the air line 80 is carried in spaced-apart eye hooks which are provided on the underside of the boom. At the outer end of the boom, a large eye hook 128 guidably supports the air line or hose, and both the hoses through which the liquid asphalt is conducted.

Although, in the embodiment illustrated, the air supply 78 is mounted separately from the other components of the apparatus 10, it should be obvious that the entire apparatus disclosed could be mounted entirely on the bed of a comparatively larger truck, or, alternatively, the trailer size could be increased to provide space for carrying the air source 78, including the storage tank, compressor and the engine for driving the compressor.

Having heretofore described the apparatus of the preferred embodiment of the present invention, in terms of a system having two sub-systems for uniting and intermixing reinforcing fiber segments in a patching and filling medium as an incident of applying a patch or conducting a filling operation, it should now be appreciated that this apparatus makes possible a unique method of road surface repair while retaining the distinct advantages of patching with fiber-filled patching material and obviating many of the problems inherent in prior systems utilizing vat mixing.

Any suitable patching material can be employed in the apparatus and method for road surface repair heretofore described, so long as the material has the necessary basic properties of asphalt cement. Asphalt cement is thermoplastic in the sense that its normal state is a somewhat resilient solid which can be transformed to a flowable thick liquid by raising its temperature a few hundred degrees through heat application. Such material can be emulsified by addition of water as a diluting solvent. In its heated flowable condition, the material will flow and conform to the internal configuration of a crack or other surface void and then resolidify to its solid state as a result of natural heat energy loss. Its resiliency and high adhesive characteristics are not noticeably affected by its reinforcement with randomly distributed fiber segments, however, such reinforcement does significantly enhance its tensile strength and general durability.

While the presently preferred embodiment has been described with some particularity, it is to be understood that other embodiments or variation may be made without departing from the spirit and scope of the invention, and that all equivalent variations are intended to be included within the scope of the appended claims.

I claim:

1. Apparatus for pavement repair, comprising:

a mobile rig, a system mounted on the rig for storing and dispensing liquid asphalt and fiber reinforcing material to a pavement repair site, including a first sub-system for storing and dispensing the liquid asphalt, a second sub-system for storing and dispensing the reinforcing material, and a manually-guided delivery nozzle assembly adapted for operator-use substantially away from the rig;

the first sub-system comprising an asphalt reservoir, heating means for maintaining the asphalt in the reservoir in a liquid flowable state, conduit means including outlet and inlet portions communicating with the reservoir and interconnecting by a flexible hose leading out to and back from the delivery nozzle assembly and establishing a flow circuit for conducting a flow of liquid asphalt from the reservoir to the nozzle assembly and back to the reservoir, pump means disposed to selectively maintain the flow of liquid asphalt in the circuit, means for selectively evacuating asphalt from, and purging, the conduit means including a first valve on the outlet portion adjacent the reservoir for shutting off the flow from the reservoir to the conduit means, a second valve for selectively directing compressed air to the conduit means to push liquid asphalt out of the conduit means and into the reservoir, valve means for temporarily entirely isolating the conduit means from the reservoir, means for selectively directing a solvent flow into the conduit means at a point between the reservoir and the pump means, and means for draining pumped solvent from the conduit means at a point on the inlet portion and closely adjacent the reservoir;

the second sub-system comprising storage means on the rig for dispensably retaining coiled fiber roving, means for guiding the roving along a path directed outwardly from the rig to the delivery nozzle assembly;

the delivery nozzle assembly comprising an asphalt dispensing nozzle in flow communication with the circuit, manually-operable valve means for selectively discharging asphalt from the circuit and through the nozzle, a fiber chopping device mounted closely adjacent and on a level above the asphalt dispensing nozzle and disposed to intercept the fiber roving and chop it into discrete filament segments, and the chopping device having an outlet tube for delivering a steady gravity flow of chopped fiber filaments to a point adjacent the dispensing nozzle for uniform dispersion in the liquid asphalt dispensed from the nozzle.

2. The apparatus of claim 1 wherein the purging means includes selectively operable valve means disposed and operable to enable selective isolation of substantially the entire circuit from the reservoir, and a solvent storage means coupled to the circuit for injecting liquid solvent into the circuit during isolation of substantially the entire circuit from the reservoir, and a normally closed port in the circuit which can be selectively opened to evacuate the circuit when solvent is pumped therethrough.

3. The apparatus of claim 1 wherein the fiber chopping device includes a motor driven chopping wheel, means for drawing the roving continuously against the wheel whereby the roving is chopped into discret filaments and dispensed through the outlet tube, the chopping wheel is rotatably driven by a pneumatic motor, and compressed air storage means on the rig having conduit means directing an airflow therefrom to the motor.

4. The apparatus of claim 1, further including a boom mounted on the rig and manually rotatable in a horizontal plane, and means on the boom for guiding the roving from the storage means, along the boom length and toward the delivery nozzle assembly.

5. The apparatus of claim 4 wherein the guide means includes a longitudinal passage through the boom.

* * * * *